US011690485B1

(12) United States Patent
Zheng

(10) Patent No.: US 11,690,485 B1
(45) Date of Patent: Jul. 4, 2023

(54) TELESCOPIC SHOWER CURTAIN ROD

(71) Applicant: Chuang Zheng, Fengcheng (CN)

(72) Inventor: Chuang Zheng, Fengcheng (CN)

( * ) Notice: Subject to any disclaimer, the term of this patent is extended or adjusted under 35 U.S.C. 154(b) by 0 days.

(21) Appl. No.: 17/878,111

(22) Filed: Aug. 1, 2022

(30) Foreign Application Priority Data

Jul. 14, 2022 (CN) ..... 202221833680.1

(51) Int. Cl.
*A47K 3/38* (2006.01)
*A47H 1/022* (2006.01)
*A47H 1/02* (2006.01)

(52) U.S. Cl.
CPC ..... *A47K 3/38* (2013.01); *A47H 1/022* (2013.01); *A47H 2001/0205* (2013.01); *A47H 2001/0215* (2013.01)

(58) Field of Classification Search
CPC .. A47K 3/38; A47H 1/022; A47H 2001/0205; A47H 2001/0215
See application file for complete search history.

(56) References Cited

U.S. PATENT DOCUMENTS 645,543 A * 3/1900 Birch ..... A47H 1/022 211/105.6
1,023,650 A * 4/1912 Hovagimian ..... A47H 1/022 211/105.6
1,140,570 A * 5/1915 Buckley ..... A47H 1/022 211/105.6
1,178,994 A * 4/1916 Crump ..... A47H 1/022 211/105.6
1,500,049 A * 7/1924 Brooks ..... A47H 1/022 211/105.6
2,079,267 A * 5/1937 Vroom ..... A47H 1/022 211/105.4
2,973,870 A * 3/1961 Schoos ..... A47H 1/022 211/105.6

(Continued)

FOREIGN PATENT DOCUMENTS

CH 625601 A5 * 9/1981
DE 3336928 A1 * 4/1985

(Continued)

*Primary Examiner* — Stanton L Krycinski

(57) ABSTRACT

The present invention discloses a telescopic shower curtain rod which comprises an outer rod, an inner rod, a spring, a knob rotating shaft and a positioning mechanism, wherein the outer rod is sleeved on the inner rod, the positioning mechanism is arranged in the inner rod, the spring is radially inserted into the inner rod, the positioning mechanism is transversely engaged on the spring, the spring cannot directly pass over the positioning mechanism to rebound, the knob rotating shaft is connected with the spring, the knob rotating shaft drives the spring to rotate, and the spring rotates to pass over the positioning mechanism to drive the inner rod to extend out of or retract into the outer rod. The advantageous effects of the present invention lie in that the spring is driven to rotate through the knob rotating shaft, the spring passes over the positioning mechanism to drive the inner rod to extend out of or retract into the outer rod, so that the extension or shortening of the shower curtain rod can be realized. Since the spring can be used in a bending way, the shower curtain rod can also be used in a way of bending the shower curtain rod into a semi-arc rod.

6 Claims, 7 Drawing Sheets

(56) References Cited

U.S. PATENT DOCUMENTS 2,988,135 A * 6/1961 Caminiti ..... B60N 2/286 211/105.6
3,572,511 A * 3/1971 Triplett ..... F16B 9/056 211/105.6
3,952,877 A * 4/1976 Kindl ..... A47H 1/022 248/200.1
3,965,960 A * 6/1976 Massey ..... A47K 3/38 4/558
4,147,199 A * 4/1979 Cameron ..... A47H 1/102 211/105.6
4,488,651 A * 12/1984 Bishop ..... A47K 3/38 211/105.6
4,492,263 A * 1/1985 Gebhard ..... E06B 9/02 160/222
5,330,061 A * 7/1994 Geltz ..... A47K 3/38 248/265
5,799,346 A * 9/1998 Tiernan ..... A47K 3/28 285/31
6,571,426 B2 * 6/2003 Chen ..... A47G 25/0692 211/105.6
6,715,163 B1 * 4/2004 Cunningham ..... A47K 3/38 4/558
6,845,955 B1 * 1/2005 Hsu ..... A47K 3/38 248/200.1
8,215,501 B2 * 7/2012 Trettin ..... A47K 3/38 211/105.6
8,479,932 B2 * 7/2013 Carney ..... A47H 1/022 403/109.5
8,505,129 B2 * 8/2013 Parker ..... A47H 1/022 248/200.1
8,925,747 B1 * 1/2015 Hanley ..... A47H 1/022 211/105.6
9,161,664 B2 * 10/2015 Zeng ..... A47K 3/38
9,591,940 B2 * 3/2017 Fenster ..... A47H 23/01
9,743,791 B2 * 8/2017 Haynesworth ..... A47H 1/08
9,968,212 B1 * 5/2018 Landmark ..... F16B 2/04
10,051,985 B2 * 8/2018 Jones ..... A47H 1/122
10,426,287 B1 * 10/2019 Tsai ..... A47H 1/022
10,531,758 B2 * 1/2020 Frett ..... A47H 1/10
10,844,890 B2 * 11/2020 Daniels ..... F16B 7/1445
10,959,559 B2 * 3/2021 Moss ..... A47H 1/102
2003/0033667 A1 * 2/2003 Lachance ..... A47K 3/38 4/608
2007/0090246 A1 * 4/2007 Carvalho ..... A47H 1/022 248/264
2009/0101609 A1 * 4/2009 Batshon ..... A47H 1/122 211/105.3
2012/0005823 A1 * 1/2012 Baines ..... A47K 3/38 4/610
2013/0047331 A1 * 2/2013 Parker ..... A47K 3/38 29/428
2013/0112639 A1 * 5/2013 Baines ..... A47K 3/38 211/123
2014/0374367 A1 * 12/2014 Morel ..... A47H 1/142 211/105.3
2022/0160158 A1 * 5/2022 Scanlon ..... A47H 1/102

FOREIGN PATENT DOCUMENTS

EP 2272404 A2 * 1/2011 ..... A47H 1/022
GB 867714 A * 5/1961
GB 2325397 A * 11/1998 ..... A47H 1/022
WO WO-02065884 A1 * 8/2002 ..... A47K 3/38

* cited by examiner

TELESCOPIC SHOWER CURTAIN ROD

CROSS REFERENCE TO RELATED APPLICATION

This application claims priority benefit of Chinese Invent Application No. 202221833680.1, filed on Jul. 14, 2022, and the entire contents of which are incorporated herein by reference.

TECHNICAL FIELD OF THE INVENTION

The present invention involves the technical field of household supplies of daily use, specifically relates to a telescopic shower curtain rod.

BACKGROUND OF THE INVENTION

A shower curtain is a curtain-like article that is hung outside a bathtub with shower heads, or in the shower area. The shower curtain is mainly used for preventing water splash of a shower from splashing to a place outside the shower; and has the function of shielding people who take a shower. The shower curtain rod is an auxiliary fitting part for fixedly hanging the shower curtain. The shower curtain rod is generally installed at different positions according to different positions and shapes of the shower area, and the shapes thereof are also different. The most common shower curtain rods are straight rod type, semi-circular and semi-arc shower curtain rods. The straight, rod type shower curtain rods are usually fixed on two opposite walls of a bathroom. Semi-circular and semi-arc shower curtain rods arc often used in shower areas or bathtubs in larger bathrooms.

In the prior art, the telescopic shower curtain rods are generally straight rods. Since the number of parts for realizing the telescopic function is too large, the straight rod cannot be bent into a semi-arc rod. When a user needs to change the structure of the bathroom, a new shower curtain rod needs to be bought again, and the cost is high. Such as a telescopic shower curtain rod (CN 215686589U) adopts the screw rod to rotate so as to realize the telescopic of the shower curtain rod, but the screw rod is hard and cannot, be bent and the rotating speed is slow, so that the telescopic time is long, and the telescopic shower curtain rod cannot be bent for use, and the requirement of daily use of a family cannot be met. Therefore, a shower curtain rod which can be freely extended or retracted, consumes short time and is convenient to use, and can be used as a straight rod and also can be bent into a semi-arc rod is urgently needed.

SUMMARY OF THE INVENTION

An object of the invention is to provide a telescopic shower curtain rod. wherein the, spring is driven to rotate through the knob rotating shaft, the spring passes over the positioning mechanism to drive the inner rod to extend out of or retract into the outer rod, so that the extension or shortening of the shower curtain rod can be realized. Since the spring can be used in a bending way, the shower curtain rod can also be used in a way of bending the shower curtain rod into a semi-arc rod.

In order to realize aforesaid object, the present invention provides the following technical solutions:

A telescopic shower curtain rod which comprises an outer rod, an inner rod, a spring, a knob rotating shaft and a positioning mechanism, wherein the outer rod is sleeved on the inner rod, the positioning mechanism is arranged in the inner rod, the spring is radially inserted into the inner rod, the positioning mechanism is transversely engaged on the spring, the spring cannot directly pass over the positioning mechanism to rebound, the knob rotating shaft is connected with the spring, the knob rotating shaft drives the spring to rotate, and the spring rotates to pass over the positioning mechanism to drive the inner rod to extend out of or retract into the outer rod.

Preferably, the positioning mechanism is a pin, the inner rod is provided with a pin hole, and the pin is inserted into the pin hole and fixed, so that the pin can be ensured to be firmly fixed, and the pin is always fixed with the inner rod and they both are pushed by the spring together.

Preferably, one end of the outer rod is connected with the knob rotating shaft through a connecting, element, the other end of the outer rod is provided with a telescopic opening, and the outer rod is fixedly connected with the knob rotating shaft through the connecting element, thereby ensuring that the outer rod only rotates and does not move left and right, when the knob rotating shaft rotates. The spring drives the inner rod and the outer rod to move relatively, so that the inner rod and the outer rod can move relatively to extend or shorten.

Preferably, the telescopic opening is provided with a protective sleeve, and the inner rod is extended or shortened from the telescopic opening. The protective sleeve can protect the inner rod and the outer rod from being abraded due to contact friction and prolong the service life thereof.

Preferably, the knob rotating shaft is provided with a positioning protrusion, the connecting element is provided with a groove, and the positioning protrusion is engaged in the groove to limit the position, which can ensure that the knob rotating shaft and the connecting element are thinly connected and are not easy to fall off.

Preferably, the shower curtain rod is further provided with a right mounting base, wherein the other end of the knob rotating shaft is connected to the right mounting base through a rotating core. The, right mounting base is abutted against the wall surface and fixed, so that the contact area of the right end of the shower curtain rod and the wall surface can be increased, the friction force is increased, and the wall surface is prevented from being damaged. The rotating core can guarantee that the rotation of knob rotating shaft cannot influence the abutting effect of the right mounting base.

Preferably, the shower curtain rod is further provided with a left mounting base, wherein the left mounting base is fixedly connected with one end of the inner rod. The left mounting base is abutted against the wall surface and fixed, so that the contact area of the left end of the shower curtain rod and the wall surface can be increased, the friction force is increased, and the wall surface is prevented from being damaged.

Preferably, the inner rod and the outer rod are elliptical rods. The elliptical rods can be convenient to use and operate, and can be less prone to slipping than circular rods.

As compared with the prior art, the advantageous effects of the present invention lie in that:

The invention is provided with an outer rod, an inner rod, a spring, a knob rotating shaft and a positioning mechanism, wherein the outer rod is sleeved on the inner rod, one end of the inner rod is arranged in the outer rod, the other end of the inner rod extends out of an opening at the left end of the outer rod, one end of the spring is connected with the knob rotating shaft, the other end of the spring extends into the opening at the right end of the outer rod, the positioning mechanism is arranged in the inner rod, the spring is formed by connecting multiple spring coils end to end, the positioning mechanism transversely penetrates through a spring coil to jam the spring, the spring cannot extend or shorten along the elastic force direction, and the spring coil rotates clockwise or counterclockwise to push the positioning mechanism to move forwards or backwards relative to the spring, so that the shower curtain rod can drive the spring to rotate clockwise through the knob rotating shaft, the spring coil of the spring rotates clockwise, the spring coil passes over the positioning mechanism, the spring moves leftwards relative to the positioning mechanism, and the positioning mechanism moves rightwards relative to the spring. Since the positioning mechanism is arranged in the inner rod, the positioning mechanism drives the inner rod to move rightwards in the outer rod, the inner rod moves rightwards relative to the outer rod, and the shower curtain rod is shortened. When the shower curtain rod drives the spring to rotate counterclockwise through the knob rotating shaft, the spring coil of the spring rotates counterclockwise, the spring coil passes over the positioning mechanism, the spring moves rightwards relative to the positioning mechanism, and then the positioning mechanism moves leftwards relative to the spring. Since the positioning mechanism is arranged in the inner rod, the positioning mechanism drives the inner rod to move leftwards in the outer rod, the inner, rod moves leftwards relative to the outer rod, the shower curtain rod extends, and finally the two ends of the shower curtain rod abut against the wall body to be used as a straight shower curtain rod. The shower curtain rod can be easily adjusted in extension or retraction through the knob rotating shaft, and is simple in structure, convenient to operate and very convenient to use.

Secondly, in the present application, the spring pushes the inner rod to move in the outer rod, and the spring is not a rigid structure and can be bent. Therefore, when a bathtub is used in a bathroom for bathing, the straight rod cannot be used as the shower curtain rod, because the straight rod can cause the shower curtain to be directly attached to the bathtub, and a user cannot stand when taking out of the bath, and it needs to use the semi-arc shower curtain rod. When the shower curtain rod drives the spring to rotate counterclockwise through the knob rotating shaft, the, spring coil of the spring rotates counterclockwise, the spring coil passes over the positioning mechanism, the spring moves rightwards relative to the positioning mechanism, and then the positioning mechanism moves leftwards relative to the spring. Since the positioning mechanism is arranged in the inner rod, the positioning mechanism drives the inner rod to move leftwards in the outer rod, the inner rod moves leftwards relative to the outer rod, the shower curtain rod extends, and finally the two ends of the shower curtain rod abut against the wall body. The knob rotating shaft is continuously rotated counterclockwise, and the shower curtain rod is continuously extended. Since both ends of the shower curtain rod are supported by the wall body and cannot extend, the inner rod, the outer rod and the spring are bent outwards, and the shower curtain rod is in a semi-arc shape. After the rotation is completed, the shower curtain rod is finally a semi-arc shower curtain rod, and both ends of the shower curtain rod are abutted against the wall body and cannot fall off. A certain buffer space is formed between the shower curtain and the bathtub, so that a user can stand in the buffer space when taking out of the bath, and the buffer space is convenient to use.

Therefore, the present invention provides a telescopic shower curtain rod, wherein the spring, is driven to rotate through the knob rotating shaft, the spring passes over the positioning mechanism to drive the inner rod to extend out of or retract into the outer rod, so that the extension or shortening of the shower curtain rod can be realized. Since the spring can be used in a bending way, the shower curtain rod can also be used in a way of bending the shower curtain rod into a semi-arc rod.

DETAILED DESCRIPTION OF THE PREFERRED EMBODIMENT

Figure 1:
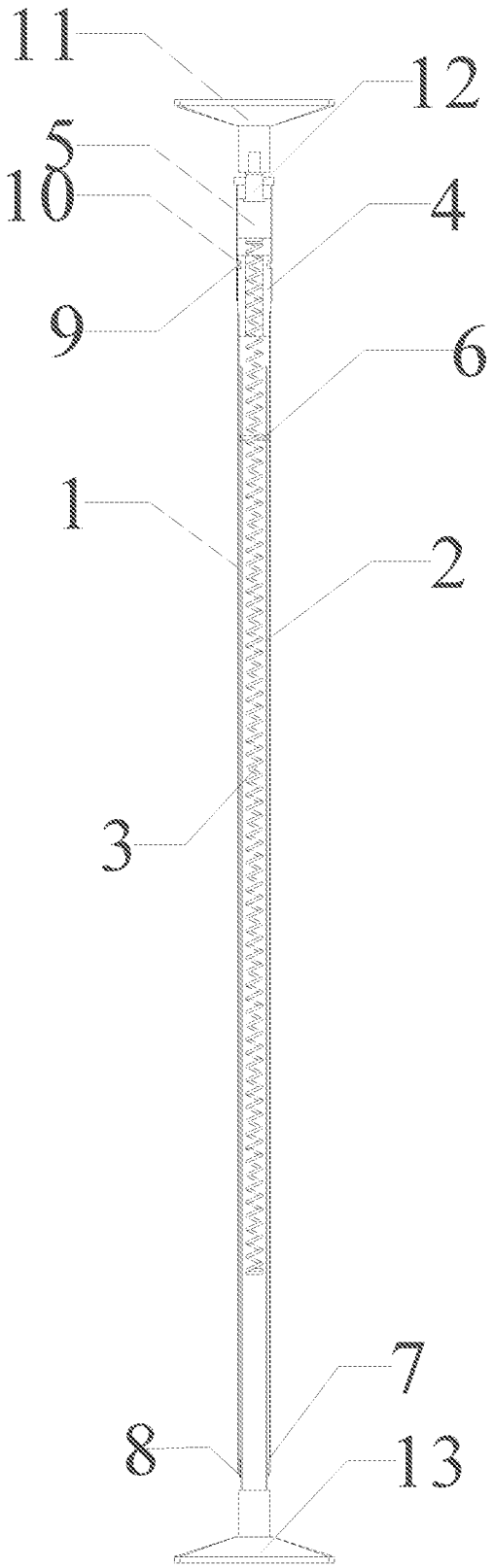
FIG. 1 is a schematic view of an internal structure of a first embodiment of the present invention. shown rotated 90 degrees compared to normal use.

The technical solutions of the embodiments of the present invention will be clearly and entirely described below with the drawings of the embodiments of the present invention. Obviously, the described embodiments are just a part of the embodiments of the present invention, and are not all of them. All other embodiments obtained by persons of ordinary skill in the art based on the embodiments of the present invention without creative efforts shall fall within the protection scope of the present invention.

It should be noted that, all the directional indications (such as up, down, left, right, front, rear . . . ) in the embodiments of the present invention are merely used for explaining the relative positional relationship and movement conditions and the like between each part under a certain posture (as shown in the drawings), if such a posture changes, then the directional indications arc changed correspondingly.

In the present invention, such description involving "first" and "second" and the like are merely for the purpose of description, but cannot be understood as indicating or implying its relative importance or implicitly indicating the quantity of the indicated technical features. Therefore, the feature defined with "first" and "second" can explicitly or implicitly include at least one such feature; secondly, in the description of the present invention, "a plurality of" means at, least two, for example, two, three and the like, unless otherwise specifically defined.

In the present invention, unless otherwise definitely prescribed and defined, the terms "connection", "connected", "fixed" and the like should be understood in its broad sense. For example, the "connection" may be a fixed connection, may also be a detachable connection or an integrated connection; may be a mechanical connection, may also be an electrical connection; and the "connected" may be directly connected and can also be indirectly connected through an intermediate medium. and can also be the internal communication inside two elements or an interaction relationship between two elements, unless otherwise definitely defined. The specific meaning of the above-mentioned, terms in the present invention may be understood by those of ordinary skill in the art in light of specific circumstances.

In addition, the technical solutions between each embodiment in the present invention can be mutually combined, but should be on the basis that the technical solutions can be realized by those skilled in the art, when the combination of the technical solutions is contradictory or cannot be realized, it should be deemed that the combination of technical solutions does not exist and does not fall within the protection scope claimed by the present invention.

Figure 2:
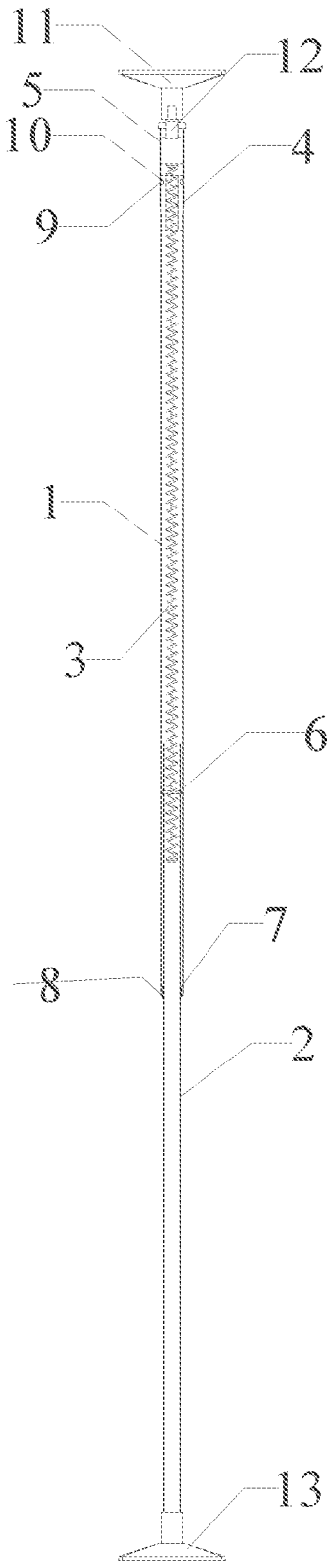
FIG. 2 is a schematic view of the internal structure of the first embodiment of the present invention in an extended state, shown rotated 90 degrees compared to normal use.
Figure 3:
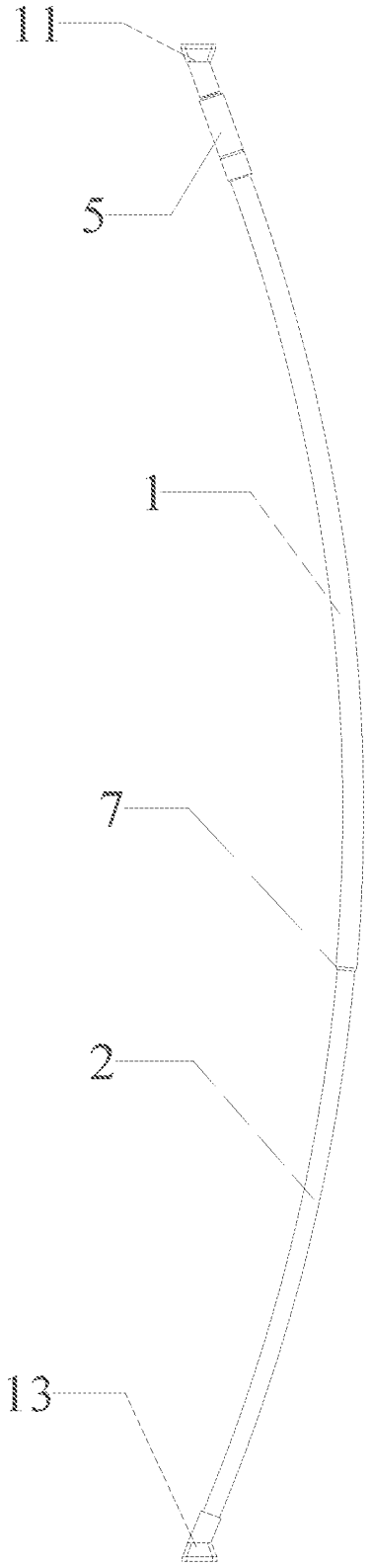
FIG. 3 is a schematic side view of the structure of the second embodiment of the present invention in an extended state, shown rotated 90 degrees compared to normal use.
Figure 4:
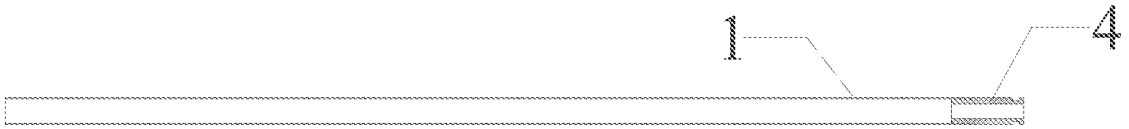
FIG. 4 is a schematic view of the assembly structure of the connecting element and the outer rod of the present invention.
Figure 5:
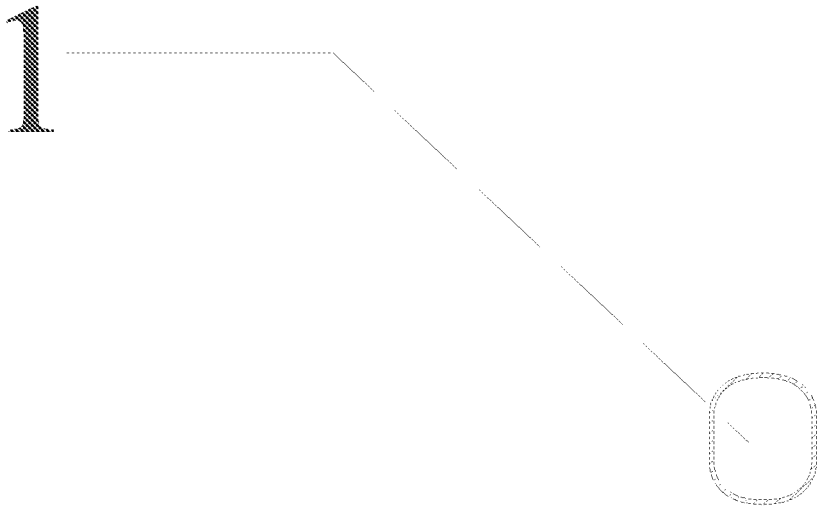
FIG. 5 is a schematic top view of the structure of the outer rod of the present invention.
Figure 6:
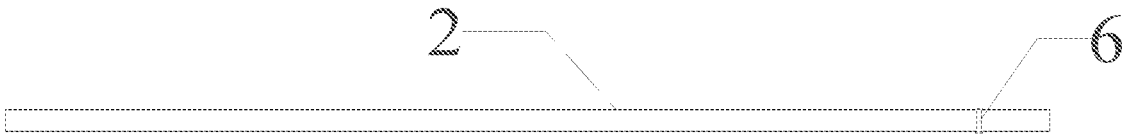
FIG. 6 is a schematic view of the assembly structure of the pin and the inner rod of the present invention.
Figure 7:
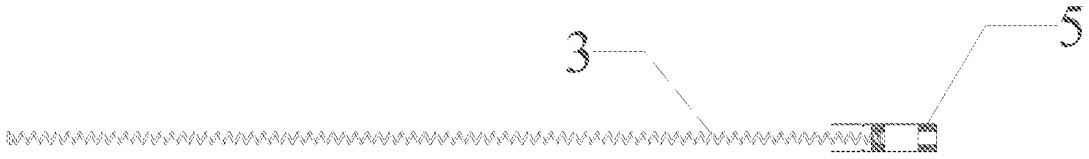
FIG. 7 is a schematic view of the assembly structure of the knob rotating shaft and the spring of the present invention.

Referring to FIGS. 1-7, FIG. 1 is a schematic view of an internal structure of a first embodiment of the present invention, shown rotated 90 degrees compared to normal use; FIG. 2 is a schematic view of the internal structure of the first embodiment of the present invention in an extended state, shown rotated 90 degrees compared to normal use; FIG. 3 is a schematic side view of the structure of the second embodiment of the present invention in an extended state, shown rotated 90 degrees compared to normal use; FIG. 4 is a schematic view of the assembly structure of the connecting element and the outer rod of the present invention; FIG. 5 is a schematic top view of the structure of the outer rod of the present invention; FIG. 6 is a schematic view of the assembly structure of the pin and the inner rod of the present invention; FIG. 7 is a schematic view of the assembly structure of the knob rotating shaft and the spring of the present invention.

The embodiment of the present invention provides a telescopic shower curtain rod.

The names of the components corresponding to the reference numerals in the figures are as follows: outer rod 1, inner rod 2, spring 3, connecting element 4, knob rotating shaft 5, pin 6, telescopic opening 7, protective sleeve 8, positioning protrusion 9, groove 10, right mounting base 11, rotating core 12, left mounting base 13.

A telescopic shower curtain rod which comprises an outer rod 1, an inner rod 2, a spring 3, a knob rotating shaft 5 and a positioning mechanism, wherein the outer rod 1 is sleeved on the inner rod 2, the positioning mechanism is arranged in the inner rod 2, the spring 3 is radially inserted into the inner rod 2, the positioning mechanism is transversely engaged on the spring 3, the spring 3 cannot directly pass over the positioning mechanism to rebound, the knob rotating shaft 5 is connected with the spring 3, the knob rotating shaft 5 drives the spring 3 to rotate, and the spring 3 rotates to pass over the positioning mechanism to drive the inner rod 2 to extend out of or retract into the outer rod 1.

The positioning mechanism is a pin 6, the inner rod 2 is provided with a pin hole, and the pin 6 is inserted into the pin hole and fixed, so that the pin 6 can be ensured to be firmly fixed, and the pin 6 is always fixed with the inner rod 2 and the pin 6 together with the inner rod 2 is pushed by the spring 3.

One end of the outer rod 1 is connected with the knob rotating shaft 5 through a connecting element 4 the other end of the outer rod 1 is provided with a telescopic opening 7, and the outer rod 1 is fixedly connected with the knob rotating shaft 5 through the connecting element 4, thereby ensuring that the outer rod 1 only rotates and does not move left and right, when the knob rotating shaft 5 rotates. The spring 3 drives the inner rod 2 and the outer rod 1 to move relatively, so that the inner rod 2 and the outer rod 1 can move relatively to extend or shorten.

The telescopic opening 7 is provided with a protective sleeve 8, and the inner rod 2 is extended or shortened from the telescopic opening 7. The protective sleeve 8 can protect the inner, rod 2 and the outer rod 1 from being abraded due to contact friction and prolong the service life thereof.

The knob rotating shaft 5 is provided with a positioning protrusion 9, the connecting element 4 is provided with a groove 10, and the positioning protrusion 9 is engaged in the groove 10 to limit the position, which can ensure that the knob rotating shaft 5 and the connecting element 4 are firmly connected and are not easy to fall off.

The shower curtain rod is further provided with a right mounting base 11, wherein the other end of the knob rotating shaft 5 is connected to the right mounting base 11 through a rotating core 12. The right mounting base 11 is abutted against the wall surface and fixed, so that the contact area of the right end of the shower curtain rod and the wall surface can be increased, the friction force is increased, and the wall surface is prevented from being damaged. The rotating core 12 can guarantee that the rotation of knob rotating shaft 5 cannot influence the abutting, effect of the right mounting base 11.

The shower curtain rod is further provided with a left mounting base 13, wherein the left mounting base 13 is fixedly connected with one end of the inner rod 2. The left mounting base 13 is abutted against the wall surface and fixed, so that the contact area of the left end of the shower curtain rod and the wall surface can be increased, the friction force is increased, and the wall surface is prevented from being damaged.

The inner rod 2 and the outer rod 1 are elliptical rods. The elliptical rods can be convenient to use and operate, and can be less prone to slipping than circular rods.

In the first embodiment, the shower curtain rod needs to be fixed on the opposite wall surfaces, and is a straight rod shower curtain rod. The use and working method of the first embodiment is as follows:

inserting the positioning mechanism into the inner rod 2 and fixing the positioning mechanism, sleeving the outer rod 1 on the inner rod 2, rotatably inserting the spring 3 into the inner rod 2 from the opening of the inner rod 2, forwardly rotating the spring 3 and passing over the positioning mechanism, connecting the spring 3 with the knob rotating shaft 5 after reaching a proper position, connecting one end of the knob rotating shaft 5 with the outer rod 1 through the connecting element 4, connecting the other end of the knob rotating shaft 5 with the right mounting base 11 through the rotating core 12, extending the left end of the inner rod 2 out of the telescopic opening 7 of the outer rod 1 and assembling the left end of the inner rod 2 with the left mounting base 13.

During the use, the both ends of shower curtain rod align with the wall surfaces, when the knob rotating shaft 5 drives the spring 3 to rotate counterclockwise, the spring coil of the spring 3 rotates counterclockwise, and the spring coil passes over the positioning mechanism, the spring 3 moves rightwards relative to the positioning mechanism, and then the positioning mechanism moves leftwards relative to the spring 3. Since the positioning mechanism is arranged in the inner rod 2, the positioning mechanism drives the inner rod 2 to move leftwards in the outer rod 1, the inner rod 3 moves leftwards relative to the outer rod 1, the shower curtain rod extends, and finally the two ends of the shower curtain rod abut against the wall body. Moreover, the spring 3 has elasticity, the spring 3 cannot directly pass over the positioning mechanism, and the elasticity of the spring 3 is applied to the left mounting base 13 and the right mounting base 11, and the assembly of the straight shower curtain rod is completed. When the shower curtain rod is to be taken down, the inner rod 2 is shortened only by rotating the knob rotating shaft 5 clockwise, the shower curtain rod does not abut against the wall surfaces at two ends and falls off from the wall surfaces, and the shower curtain rod is recovered.

In the second embodiment, a large bathtub is used in the bathroom, and the shower curtain rod is a semi-arc shower curtain rod. The use and working method of the second embodiment is as follows:

inserting the pin 6 into the inner rod 2 and fixing the pin, sleeving the outer rod 1 on the inner rod 2, rotatably inserting the spring 3 into the inner rod 2 from the opening of the inner rod 2, forwardly rotating the spring 3 and passing over the pin 6, connecting the spring 3 with the knob rotating shaft 5 after reaching a proper position, connecting one end of the knob rotating shaft 5 with the outer rod 1 through the connecting element 4, connecting the other end of the knob rotating shaft 5 with the right mounting base 11 through the rotating core 12, extending the left end of the inner rod 2 out of the telescopic opening 7 of the outer rod 1, and assembling the left end of the inner rod 2 with the left mounting base 13.

During the use, the both ends of shower curtain rod align with the wall surfaces, when the knob rotating shaft 5 drives the spring 3 to rotate counterclockwise, the spring coil of the spring 3 rotates counterclockwise, and the spring coil passes over the pin 6, the spring 3 moves rightwards relative to the pin 6, and then the pin 6 moves leftwards relative to the spring 3. Since the pin 6 is arranged in the inner rod 2, the pin 6 drives the inner rod 2 to move leftwards in the outer rod 1, the inner rod 3 moves leftwards relative to the outer rod 1, the shower curtain rod extends, and finally the two ends of the shower curtain rod abut against the wall body. The knob rotating shaft 5 is continuously rotated counterclockwise, and the shower curtain rod is continuously extended. Since both ends of the shower curtain rod are supported by the wall body and, cannot extend, the inner rod 2, the outer rod 1 and the spring 3 are bent outwards, and the shower curtain rod is in a semi-arc shape. After the rotation is completed, the shower curtain rod is finally a semi-arc shower curtain rod, and both ends of the shower curtain rod are abutted against the wall body and cannot fall off, and the assembly of the semi-arc shower curtain rod is completed. When the shower curtain rod is to be taken down, the inner rod 2 is shortened only by rotating the knob rotating shaft 5 clockwise, the shower curtain rod does not abut against the wall surfaces at two ends and falls off from the wall surfaces, and the shower curtain rod is recovered.

As compared with the prior art, the advantageous effects of the present invention lie in that:

The invention is provided with an outer rod 1, an inner rod 2, a spring 3, a knob rotating shaft 5 and a positioning mechanism, wherein the outer rod 1 is sleeved on the inner rod 2, one end of the inner rod 2 is arranged in the outer rod 1, the other end of the inner rod 2 extends out of an opening at the left end of the outer rod 1, one end of the spring 3 is connected with the knob rotating shaft 5, the other end of the spring 3 extends into the opening, at the right end of the outer rod 1, the positioning mechanism is arranged in the inner rod 2, the spring 3 is formed by connecting multiple spring coils end to end, the positioning mechanism transversely penetrates through a spring coil to jam the spring 3, the spring 3 cannot extend or shorten along the elastic force direction, and the spring coil rotates clockwise or counterclockwise to push the positioning mechanism to move forwards or backwards relative to the spring, so that the shower curtain rod can drive the spring 3 to rotate clockwise through the knob rotating shaft 5, the spring coil of the spring 3 rotates clockwise, the spring coil passes over the positioning mechanism, the spring moves leftwards relative to the positioning mechanism, and the positioning mechanism moves rightwards relative to the spring 3. Since the positioning mechanism is arranged in the inner rod 2, the positioning mechanism drives the inner rod 2 to move rightwards in the outer rod 1, the inner rod 2 moves rightwards relative to the outer rod 1, and the shower curtain rod is shortened. When the shower curtain rod drives the spring 3 to rotate counterclockwise through the knob rotating shaft 5, the spring coil of the spring 3 rotates counterclockwise, the spring coil passes over the positioning mechanism, the spring 3 moves rightwards relative to the positioning mechanism, and then the positioning mechanism moves leftwards relative to the spring 3. Since the positioning mechanism is arranged in the inner rod 2, the positioning mechanism drives the inner rod 2 to move leftwards in the outer rod 1, the inner rod 2 moves leftwards relative to the outer rod 1, the shower curtain rod extends, and finally the two ends of the shower curtain rod abut against the wall body to be used as a straight shower curtain rod. The shower curtain rod can be easily adjusted in extension and retraction through the knob rotating shaft 5, and is simple in structure, convenient to operate and very convenient to use.

Secondly, in the present application, the spring 3 pushes the inner rod 2 to move in the outer rod 1, and the spring 3 is not a rigid structure and can be bent. Therefore, when a bathtub is used in a bathroom for bathing, the straight rod cannot be used as the shower curtain rod, because the straight rod can cause the shower curtain to be directly attached to the bathtub, and a user cannot stand when taking out of the bath, and it needs to use the semi-arc shower curtain rod. When the shower curtain rod drives the spring 3 to rotate counterclockwise through the knob rotating shaft 5, the spring coil of the spring 3 rotates counterclockwise, the spring coil passes over the positioning mechanism, the spring 3 moves rightwards relative to the positioning mechanism, and then the positioning mechanism moves leftwards relative to the spring 3. Since the positioning mechanism is arranged in the inner rod 2, the positioning mechanism drives the inner rod 2 to move leftwards in the outer rod 1, the inner rod 3 moves leftwards relative to the outer rod 1, the shower curtain rod extends, and finally the two ends of the shower curtain rod abut against the wall body. The knob rotating shaft 5 is continuously rotated counterclockwise, and the shower curtain rod is continuously extended. Since both ends of the shower curtain rod are supported by the wall body and cannot extend, the inner rod 2, the outer rod 1 and the spring 3 are bent outwards, and the shower curtain rod is in a semi-arc shape. After the rotation is completed, the shower curtain rod is finally a semi-arc shower curtain rod, and both ends of the shower curtain rod are abutted against the wall body and cannot fall off. A certain buffer space is formed between the shower curtain and the bathtub, so that a user can stand in the buffer space when taking out of the, bath, and the buffer space is convenient to use.

Therefore, the present invention provides a telescopic shower curtain rod, wherein the spring 3 is driven to rotate through the knob rotating shaft 5, the spring 3 passes over the positioning mechanism to drive the inner rod 2 to extend out of or retract into the outer rod 1, so that the extension or shortening of the shower curtain rod can be realized. Since the spring 3 can be used in a bending way, the shower curtain rod can also be used in a way of bending the shower curtain rod into a semi-arc rod.

The above described embodiments are only the preferred embodiments of the present invention. It should be noted that, the present invention is not limited to the above preferred embodiments, and the protection scope of the present invention is defined by the claims. For a person skilled in the art, on the premise of not departing away from the spirit and scope of the present invention, several improvements and modifications may also be made, and such improvements and modifications are also deemed to be within the protection scope of the present invention.

The invention claimed is:

1. Telescopic shower curtain rod, characterized in that it comprises an outer rod, an inner rod, a spring, a knob rotating shaft and a positioning mechanism, wherein the outer rod is sleeved on the inner rod, the positioning mechanism is arranged in the inner rod, the spring is radially inserted into the inner rod, the positioning mechanism is transversely engaged on the spring, the spring cannot directly pass over the positioning mechanism to rebound, the knob rotating shaft is connected with the spring, the knob rotating shaft drives the spring to rotate, and the spring rotates to pass over the positioning mechanism to drive the inner rod to extend out of or retract into the outer rod, one end of the outer rod is connected with the knob rotating shaft through a connecting element, and the other end of the outer rod is provided with a telescopic opening, the knob rotating shaft is provided with a positioning protrusion, the connecting element is provided with a groove, and the positioning protrusion is engaged in the groove to limit their positions.

2. Telescopic shower curtain rod according to claim 1, characterized in that the positioning mechanism is a pin, the inner rod is provided with a pin hole, and the pin is inserted into the pin hole and fixed.

3. Telescopic shower curtain rod according to claim 1, characterized in that the telescopic opening is provided with a protective sleeve, and the inner rod is extended or shortened from the telescopic opening.

4. Telescopic shower curtain rod according to claim 1, characterized in that further a right mounting base is provided, wherein another end of the knob rotating shaft is connected to the right mounting base through a rotating core.

5. Telescopic shower curtain rod according to claim 1, characterized in that further a left mounting base is provided, wherein the left mounting base is fixedly connected with one end of the inner rod.

6. Telescopic shower curtain rod according to claim 1, characterized in that the inner rod and the outer rod are elliptical rods.

* * * * *